US006284016B1

(12) United States Patent
Kitamura et al.

(10) Patent No.: US 6,284,016 B1
(45) Date of Patent: Sep. 4, 2001

(54) PRESSURE CONVERTER STEELMAKING METHOD

(75) Inventors: Shinya Kitamura; Michitaka Matsuo; Kenichiro Naito, all of Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/381,359

(22) PCT Filed: Mar. 19, 1998

(86) PCT No.: PCT/JP98/01188

§ 371 Date: Sep. 20, 1999

§ 102(e) Date: Sep. 20, 1999

(87) PCT Pub. No.: WO98/42879

PCT Pub. Date: Oct. 1, 1998

(30) Foreign Application Priority Data

Mar. 21, 1997 (JP) ..... 9-67149
Mar. 21, 1997 (JP) ..... 9-67150

(51) Int. Cl.[7] ..... C21B 5/35
(52) U.S. Cl. ..... 75/378
(58) Field of Search ..... 75/378

(56) References Cited

FOREIGN PATENT DOCUMENTS

60197805 * 10/1985 (JP) .
62146210 * 6/1987 (JP) .
62263912 * 11/1987 (JP) .
8-60220 3/1996 (JP) .
9-170011 6/1997 (JP) .

* cited by examiner

*Primary Examiner*—Roy King
*Assistant Examiner*—Tima McGuthry-Banks
(74) *Attorney, Agent, or Firm*—Wenderoth, Lind & Ponack, L.L.P.

(57) ABSTRACT

The invention intends to provide a converter refining method capable of blowing molten steel having a low degree of superoxidation with high productivity and high yield. A first aspect resides in a pressurized converter steelmaking method for use in a top-and-bottom blowing converter, wherein a converter internal pressure P is set to a higher level than the atmospheric pressure, and a top-blown oxygen flow rate F and a bottom-blown gas flow rate Q are adjusted depending on changes of the converter internal pressure P. A second aspect resides in a pressurized converter steelmaking method for use in a top-and-bottom blowing converter, wherein a converter internal pressure P is set to a higher level than the atmospheric pressure during the whole or a part of a blowing period, and a top-blown oxygen flow rate F, a bottom-blown gas flow rate Q and the converter internal pressure P are changed depending on a steel bath carbon concentration C.

14 Claims, 5 Drawing Sheets

PRESSURE CONVERTER STEELMAKING METHOD

TECHNICAL FIELD

The art of this invention relates to a pressurized converter steelmaking method capable of blowing molten steel with high productivity, high yield, and a low degree of superoxidation.

BACKGROUND ART

The ultimate aim of converter refining is to blow molten steel having a low degree of superoxidation with high productivity and high yield. The decarburization behavior in converter refining is divided into a period I in which the decarburization rate is determined by a flow rate of oxygen supplied to molten iron in a region where the molten iron has a high carbon concentration, and a period II in which the decarburization rate is determined by a mass transfer rate of carbon in molten iron in a region where the molten iron has a low carbon concentration.

To improve the productivity in converter refining, it is required to increase the decarburization rate in the period I which occupies a large part of the refining time. For that purpose, the flow rate of oxygen supplied to molten iron requires to be increased in principle. However, the oxygen flow rate in a general top-and-bottom blowing converter has an upper limit of about 4 ($Nm^3$/ton/min). If the oxygen flow rate is increased beyond the upper limit value, violent splashes would come out, the amount of dust would be increased, and a phenomenon called slopping would occur. The occurrence of those phenomena reduces yield of molten steel, increases deposition of skull onto the top of the converter, and increases the amount of waste slag beneath the converter. Accordingly, problems of prolonging a non-blowing time such as taken to remove the skull and clean the ground beneath the converter and lowering the productivity are rather encountered.

There are known several techniques of pressurizing a converter for the purpose of increasing the oxygen flow rate and suppressing the occurrence of dust during the period I. As described below, however, any of the known techniques is not sufficient to provide satisfactory operating conditions.

For achieving improved yield of molten steel, it is needed not only to reduce the occurrence of dust and splashes during the period I, but also to suppress the iron oxidation loss occurred during the period II. In the region where molten steel has a low carbon concentration during the period II, an iron oxidation loss occurs because the molten steel is brought into a superoxidated state, and iron is oxidized and released into slag. Superoxidation of molten steel increases the amount of (T·Fe) in slag (i.e., total iron components contained in slag in the form of iron oxides or iron), and also increases an oxygen concentration in the molten steel. This gives rise to an additional problem that a large amount of deoxidizing agent is required and purity of the molten steel is considerably deteriorated due to deoxidation products generated in a large amount.

For suppressing superoxidation during the period II, it is conceivable in principle to reduce the oxygen flow rate and to increase stirring intensity. A reduction of the oxygen flow rate however prolongs the refining time, and therefore accompanies a problem that an improvement of the productivity cannot be achieved at the same time. Also, an increase of bottom-blow stirring intensity results in an increase of the stirring gas cost. An increase of the stirring gas cost can be suppressed by holding low the stirring intensity during the period I and increasing the stirring intensity only during the period II. However, due to lack of technology for remarkably changing the bottom-blown gas flow rate at the same tuyere, this method raises another problem that the wearing rate of bottom-blow tuyere bricks is increased.

Meanwhile, there are known several techniques of pressurizing the interior of a converter for the purpose of increasing the oxygen flow rate and suppressing the generation of dust. However, any of the known techniques is not sufficient to provide satisfactory operating conditions as follows.

Japanese Examined Patent Publication No. 43-9982 discloses an iron refining method comprising the steps of placing both an iron charge and a slag making component in a top blown converter, introducing oxygen through a lance positioned in the converter, causing the oxygen to flow over the surface of the iron charge located below the lance, thereby developing a refining reaction to remove carbon from iron and to generate a reactor gas, causing the reactor gas to flow from the converter to a gas collecting device, providing pressure adjusting means for controlling the gas velocity, and holding a close relation between the iron charge and the pressure adjusting means so that essentially all of the gas passes the pressure adjusting means. In addition, the pressure adjusting means is controlled so as to provide at least one atmospheric pressure within the converter when the iron charge is refined with the introduced oxygen.

The technique disclosed in the above publication is featured in that a carbon dioxide production ratio (post combustion rate) raises, and the amount of dust is reduced because a mass flow rate of the waste gas is lowered. The disclosed technique however contains no quantitative restrictions with regard to the oxygen flow rate and the relationship between impingement energy of a top-blown oxygen jet upon the bath surface and pressure, which greatly affect the post combustion rate and the amount of dust generated. Further, the disclosed technique relates to a top blown converter, and greatly differs in basic conditions from refining with a top-and-bottom blowing converter. Accordingly, a converter cannot be operated as a pressurized converter based on the disclosed invention alone.

Japanese Unexamined Patent Publication No. 2-205616 discloses a highly-efficient converter steelmaking method for refining iron materials, such as molten iron and scraps if necessary, to molten steel, wherein the interior of a converter is pressurized to 0.5 $kgf/cm^2$ or more, the relationship between a total amount W (t/ch) of molten pig iron and scraps both charged into the converter and an inner volume V ($m^3$) of the converter shell is set to satisfy $W>0.8$ V or $0.8 V \geqq W \geqq 0.5$. V, and an oxygen flow rate U ($Nm^3$/min·t) into the converter is set to satisfy $U \geqq 3.7$. This publication explains that the occurrence of slopping and spitting was suppressed and high yield was obtained under pressurization.

However, the above-cited publication does not discuss the conditions for suppressing the occurrence of slopping and spitting in relation to the oxygen supply condition and the relationship between stirring intensity and the pressurizing condition. It is therefore impossible to carry out the operation of a pressurized converter based on the invention disclosed in the above-cited publication alone. In a top-and-bottom blowing converter, which is subjected to strong stirring intensity, particularly, slopping hardly occurs even at normal pressure under the conditions of the comparative example described in the above-cited publication. Thus, because of great difference in basic conditions, it is difficult to obtain the pressurized operating conditions for the top-and-bottom blowing converter from the invention disclosed in the above-cited publication.

Moreover, the above-cited publication does not explain a method for operating the converter under the condition of low carbon concentration during the period II, which is most important from the viewpoint of suppressing superoxidation and improving yield.

Japanese Unexamined Patent Publication No. 62-142712 discloses a steel- and iron-making method in a converter or a smelting reduction furnace, wherein the internal pressure of the converter or the smelting reduction furnace is set to a level higher than the atmospheric pressure, particularly in the range of 2–5 kg/cm$^2$, so that the linear velocity of post combustion gas is lowered.

The invention disclosed in the above-cited publication intends to lower the velocity of rising flow of post combustion gas in slag under pressurization and to prolong a heat-exchange time between the gas and the slag, thereby improving the heat efficiency through the slag. The disclosed invention explains that the interior of the converter or furnace is pressurized to 2–5 kg/cm$^2$, but contains no restrictions with regard to the amount of slag, the amount of post combustion gas generated, the oxygen flow rate, the height of a lance, the depth of a cavity, etc. which affect the heat-exchange time between the gas and the slag, in spite of that the heat-exchange time dominates the heat efficiency in accordance with the principles of the disclosed invention. It is therefore impossible to carry out the operation of a pressurized converter based on the disclosed invention alone. In particular, because an embodiment of the disclosed invention concerns with a top blown converter, basic conditions are greatly different between the disclosed invention and the case of employing a top-and-bottom blowing converter in which slag forming is hard to develop due to strong stirring intensity, or the case of blowing molten pig iron prepared through the hot metal pretreatment process in which the amount of slag is small. It is hence difficult to obtain the pressurized operating conditions for the top-and-bottom blowing converter from the disclosed invention.

Japanese Unexamined Patent Publication No. 2-298209 discloses a pressurized iron-containing-cold-material melting converter steelmaking method comprising the steps of supplying an iron-containing cold material, a carbon material and oxygen to a specific melting converter in which a source of molten iron is present, producing high-carbon molten iron in an amount equal to total of a predetermined amount of the source molten iron in the specific melting converter and a predetermined amount of molten iron to be refined in a separate specific refining converter, and obtaining molten steel having desired components by blowing the high-carbon molten iron, as materials, with oxygen in the specific refining converter, wherein the internal pressure of the specific melting converter is controlled in accordance with the following formula to thereby achieve a remarkable reduction of the amount of dust generated in the specific melting converter;

$$P \geqq 1.15+0.3\{[\%\ C]-25\}25 \geqq [\%\ C] \geqq 5$$

symbol P: internal pressure (atm) of the specific melting converter, and

[% C]: C content (weight %) of molten iron in the specific melting converter.

The invention disclosed in the above-cited publication utilizes the facts that impingement energy of a top-blown oxygen jet upon the bath surface is reduced under pressurization, and the volume of generated CO gas is also reduced under pressurization. Because CO tends to generate in a larger amount as the molten iron has a higher carbon concentration, the pressure is set to a higher level depending on the carbon concentration. However, the above formula is applied to the C content ranging from 2.5 to 5%, and therefore cannot be applied to converter refining aiming at decarburization. Also, the generation rate of dust depends on not only merely pressure but also the oxygen flow rate to a large extent, and the oxygen flow rate is an important factor which dominates the productivity of a converter for melting an iron-containing cold material. Nevertheless, the disclosed invention contains no quantitative restrictions with regard to the oxygen flow rate and the relationship between impingement energy of a top-blown oxygen jet upon the bath surface and pressure. Additionally, the disclosed invention greatly differs in basic conditions from converter refining aiming at decarburization. It is therefore impossible to carry out the operation of a pressurized converter based on the disclosed invention alone.

Furthermore, any of the above-described known arts does not disclose a method for operating a converter in the low-carbon region during the period II, which is most important from the viewpoint of suppressing superoxidation and improving yield. In the period II, particularly, it is impossible to suppress superoxidation and to improve yield, while improving the productivity, unless such conditions as the top-blown oxygen flow rate and stirring intensity due to bottom blowing are properly controlled in addition to the internal pressure of the converter.

Conventionally, $\epsilon$ defined by the following formula (1) is used as stirring energy due to bottom blowing ("Tetsu to hagane", Vol. 67, 1981, p. 672 ff.), and there is known the relationship between a BOC value and a decarburization characteristic of a converter through a homogenous mixing interval $\tau$ determined by the following formula (2) ("Tetsu to haganew", Vol. 68, 1982, p. 1946 ff.).

$$\epsilon=(371/Wm)\cdot Q\cdot T\cdot\{\log(1+(9.8\cdot\rho\cdot H/P)\cdot(10^{-4}))\} \quad (1)$$

$$\tau=540\cdot(H/0.125)^{2/3}\cdot\rho^{1/3}\cdot\epsilon \quad (2)$$

$$BOC=\{F/(1/\tau)\}x[\%C] \quad (3)$$

In these formulae, Q is the bottom-blown gas flow rate (Nm$^3$/ton/min), T is the temperature (K) of molten steel, $\rho$ is the density of molten steel, H is the bath depth, P is the internal pressure (kg/cm$^2$) of a converter, F is the top-blown oxygen flow rate (F: Nm$^3$/ton/min), [% C] is the carbon concentration, and Wm is the amount of molten steel (ton).

From the above relationships, it was estimated that in the case of the converter having the bath depth of 1–2 m, for example, even when the converter internal pressure is raised from 1 kg/cm$^2$ to 3 kg/cm$^2$, effects upon $\epsilon$ and BOC are not remarkable and metallurgical characteristics are not greatly affected.

On the other hand, the following formula (4) is employed in calculating the depth of a cavity formed by top-blown gas (Kiyoshi Segawa: "Iron Metallurgical Reaction Engineering", 1977, Nikkan Kogyo Shimbun, Ltd.), but the effect of the converter internal pressure is not included in the formula (4).

$$L'=L_h\cdot\exp(-0.78h/L_h)L_h=63.0(F'/nd)^{2/3} \quad (4)$$

In these formulae, L' is the cavity depth (mm) calculated by the above formula (4), h is the distance between the lance and the steel bath surface, F' is the top-blown oxygen flow rate ($Nm^3$/Hr), n is the number of nozzles, and d is the nozzle diameter (mm).

Also, for post combustion, there have been proposed relation with respect to L' resulted from the above formula (4) and relation with respect to $(X-H_c)/d$, i.e., a ratio of the difference between the distance X from the lance tip to the bath surface and the length $H_c$ of a supersonic core to the nozzle diameter d ("Tetsu to hagane", Vol. 73, 1987, p. 1117 ff.). With regard to the latter relation, particularly, it is suggested that CO in the atmosphere is caught up into an oxygen jet and is subjected to post combustion for conversion into $CO_2$ in a peripheral region of the jet where the velocity of the jet is relatively low. The article however does not describe changes depending on the converter internal pressure.

For the effect of the pressure upon the cavity depth, the behavior in a depressurized state is reported ("Tetsu to hagane", Vol. 63, 1977, p. 909 ff.). This article explains that the cavity depth is abruptly increased by decreasing the pressure. In other words, the article shows the result obtained at the atmospheric pressure or below, but contains no suggestions about the behavior in a pressurized state. If the result obtained at the atmospheric pressure or below is extrapolated to a region pressurized above the atmospheric pressure, the cavity depth is very small.

DISCLOSURE OF THE INVENTION

The present invention overcomes the problems that when the oxygen flow rate is increased in ordinary converter refining under the atmospheric pressure, splashes and dust are generated in a larger amount, and the occurrence of slopping lowers yield of molten steel and prolongs the non-blowing time. The pressurized converter techniques disclosed in Japanese Unexamined Patent Publication No. 2-205616, No. 2-298209 and No. 62-142712, as well as Japanese Examined Patent Publication No. 43-9982 state neither the pressurized operating conditions in a top-and-bottom blowing converter which differs in basic conditions from the converters disclosed in the above-cited publications, nor a method for operating a converter in the low-carbon region during the period II, which is most important from the viewpoint of suppressing superoxidation and improving yield. It is therefore impossible to carry out the operation of a pressurized converter based on the inventions disclosed in the above-cited publications. The present invention also overcomes the above problem. As a result of overcoming those problems, an object of the present invention is to provide a converter refining method which is capable of blowing molten steel having a low degree of superoxidation with high productivity and high yield.

The inventors have found that, when carrying out decarburization while the interior of a top-and-bottom blowing converter is pressurized, the top-blown oxygen flow rate and the bottom-blown gas flow rate are required to be adjusted and controlled depending on changes in converter pressure and carbon concentration. The present invention is featured by the following methods.

(1) A pressurized converter steelmaking method for use in a top-and-bottom blowing converter, wherein a converter internal pressure (P1: $kg/cm^2$) is set to a higher level than the atmospheric pressure, and a top-blown oxygen flow rate (F1: $Nm^3$/ton/min) and a bottom-blown gas flow rate (Q1: $Nm^3$/ton/min) are adjusted depending on changes of the converter internal pressure; P1.

(2) A pressurized converter steelmaking method for use in a top-and-bottom blowing converter, wherein in a region in which a steel bath carbon concentration is higher than 0.5%, a converter internal pressure (P1: $kg/cm^2$) is set to a higher level than the atmospheric pressure, and a top-blown oxygen flow rate (F1: $Nm^3$/ton/min) and a bottom-blown gas flow rate (Q1: $Nm^3$/ton/min) are controlled to hold F1/P1 in the range of 1.1–4.8 and Q1/P1 in the range of 0.05–0.35.

(3) In the pressurized converter steelmaking method of the above (1) or (2), a ratio (L/D) of a depth (L: m) of a cavity formed in the steel bath surface by top-blown oxygen to a bath diameter (D: m) is controlled to be held in the range of 0.08–0.3.

Here, the converter internal pressure is an absolute pressure (atmospheric pressure=1 $kg/cm^2$).

(4) A pressurized converter steelmaking method for use in a top-and-bottom blowing converter, wherein a converter internal pressure (P2: $kg/cm^2$) is set to a higher level than the atmospheric pressure during the whole or a part of a blowing period, and a top-blown oxygen flow rate (F2: $Nm^3$/ton/min), a bottom-blown gas flow rate (Q2: $Nm^3$/ton/min) and the converter internal pressure P2 are changed depending on a steel bath carbon concentration (C: wt %).

(5) In the pressurized converter steelmaking method of the above (4), in a region in which the steel bath carbon concentration; C is not higher than 1%, the converter internal pressure; P2 is controlled to be held in a range between PA defined by the following formula (5) and PB defined by the following formula (6):

$$PA=0.8+5\times C \quad (5)$$

$$PB=2\times C \quad (6)$$

Although PA and PB may take a value not more than 1 from the above formulae, P2 should not be 0.9 $kg/cm^2$ or less.

(6) In the pressurized converter steelmaking method of the above (5), β in the following formula (7) expressed using a ratio of the top-blown oxygen flow rate (F1; $Nm^3$/ton/min) in a region in which C is higher than 1%, to the top-blown oxygen flow rate; F2 in a region in which C is not higher than 1% is controlled to be held in the range of −0.25 to 0.5:

$$\beta=(F2/F1)-C \quad (7)$$

Although F2 may be greater than F1 in the above formula, F2 is assumed to be not greater than F1. Also, F2 may take a minus value, but should not be 0.5 $Nm^3$/ton/min or less.

(7) In the pressurized converter steelmaking method of the above (5), γ in the following formula (8) expressed using a ratio of the bottom-blown gas flow rate (Q1; $Nm^3$/ton/min) in a region in which C is higher than 1%, to the bottom-blown gas flow rate Q2 in a region in which C is not higher than 1% is controlled to be held in the range of −2 to 1:

$$\gamma=(Q2/Q1)-5\times(1-C) \quad (8)$$

(8) In the pressurized converter steelmaking method of the above (4), the converter internal pressure; P2, the top-blown oxygen flow rate; F2, and the bottom-blown gas flow rate; Q2 in a region in which C is 1–0.1% are controlled so that δ expressed by the following formula (9) is held in the range of 5–25:

$$\delta=\{(F2\times P2)/Q2\}^{1/2}/C \quad (9)$$

(9) In the pressurized converter steelmaking method of the above (4) to (8), a ratio (L/D) of a depth (L: m) of a cavity formed in the steel bath surface by top-blown oxygen to a bath diameter (D: m) is controlled to be held in the range of 0.15–0.35.

(10) A pressurized converter steelmaking method, wherein a lower limit of the steel bath carbon concentration for performing the control defined in the above (2) or (3) is held in the range of CB×0.6 to CB×1.8, CB being expressed by the following formula (10):

$$CB=0.078\times P+0.058\times F-1.3\times Q-0.00069\times Wm+0.49 \quad (10)$$

wherein

P: converter internal pressure (kg/cm$^2$)

F: top-blown oxygen flow rate (Nm$^3$/ton/min)

Q: bottom-blown gas flow rate (Nm$^3$/ton/min)

Wm: amount of molten steel (ton)

(11) A pressurized converter steelmaking method, wherein the steel bath carbon concentration for starting the control defined in the above (5) to (9) is held in the range of CB×0.6 to CB×1.8, CB being expressed by the formula (10).

(12) In the pressurized converter steelmaking method of the above (4), after the steel bath carbon concentration; C has entered a region corresponding to the range of CB×0.6 to CB×1.8, CB being expressed by the formula (10), the converter internal pressure P, the top-blown oxygen flow rate F, and the bottom-blown gas flow rate Q are controlled so that CB expressed by the formula (10) is held in the range of C×0.6 to C×1.8.

The carbon concentration during blowing is a value derived by estimation from the decarburization oxygen efficiency empirically obtained based on total oxygen consumption by top blowing and bottom blowing, or indirect estimation from intermedium sampling or waste gas analysis, or a continuous or semi-continuous direct analytical value from on-line analysis or on-site analysis.

Also, the cavity depth L is calculated from the following formulae.

$$LG=H_c/(0.016\cdot L^{0.5})-L \quad (11)$$

$$H_c=f(P_O/P_{OP})\cdot M_{OP}\cdot(4.2+1.1M_{OP}^2)\cdot d$$

$$f(X)=-2.709X^4+17.71X^3-40.99X^2+40.29X-12.90(0.7<X<2.1)$$

$$f(X)=0.109X^3-1.43X^2+6.63X-6.35(2.1X<2.5)$$

$$X=P_O/P_{OP}$$

L: cavity depth (mm) of molten iron

LG: distance (mm) between the lance tip and the static molten iron surface $P_O$: absolute pressure (kgf/cm$^2$) at the nozzle inlet $P_{OP}$: nozzle absolute pressure (kgf/cm$^2$) at correct expansion $M_{OP}$: discharge Mach number (–) at correct expansion d: nozzle throat diameter Here, the absolute pressure $P_O$ at the lance nozzle inlet means absolute pressure at the stagnation point before the lance nozzle throat. Also, the lance nozzle absolute pressure $P_{OP}$ at correct expansion is calculated by the following formula (12).

$$S_e/S_t=0.259(P/P_{OP})^{-5/7}\{1-(P/P_{OP})^{2/7}\}^{-1/2} \quad (12)$$

$S_e$: area (mm$^2$) of the lance nozzle outlet $S_t$: area (mm$^2$) of the lance nozzle throat P: atmosphere absolute pressure (kgf/cm$^2$) at the lance nozzle outlet $P_{OP}$: lance nozzle absolute pressure (kgf/cm$^2$) at correct expansion Here, the discharge Mach number $M_{OP}$ at correct expansion in the above formula (11) is calculated by the following formula (13).

$$M_{OP}=[5\cdot\{(P_{OP}/P)^{2/7}-1\}]^{1/2} \quad (13)$$

$M_{OP}$: discharge Mach number (–) at correct expansion

P: atmosphere absolute pressure (kgf/cm$^2$) at the lance nozzle outlet $P_{OP}$: lance nozzle absolute pressure (kgf/cm$^2$) at correct expansion Also, the oxygen gas flow rate is calculated by the following formula (14).

$$F_{O2}=0.581\cdot S_t\cdot\epsilon\cdot P_O \quad (14)$$

$S_t$: area (mm$^2$) of the lance nozzle throat $P_O$: absolute pressure (kgf/cm$^2$) at the lance nozzle inlet $F_{O2}$: oxygen gas flow rate (Nm$^3$/h)

$\epsilon$: flow rate coefficient (–) (usually in the range of 0.9–1.0)

BEST MODE FOR CARRYING OUT THE INVENTION

Figure 1:
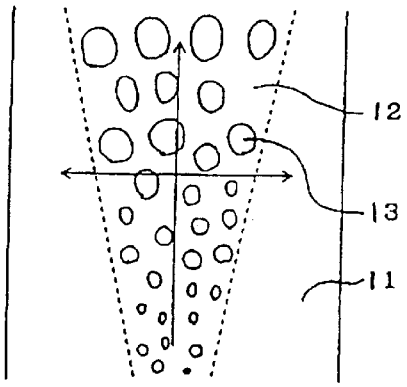
[FIG. 1] is a schematic view showing behavior of bubbles blown into a bath.

The methods (1)–(3) and (10) according to the present invention will be described below in detail.

Pressurizing conditions in a top-and-bottom blowing converter basically differ between the period I and the period II.

In the period I, pressurization intends to increase the oxygen flow rate for improving the productivity, and conditions for suppressing the occurrence of splashes, dust and slopping resulted from an increase of the oxygen flow rate are important. The term "splashes" means scatters of molten iron resulted with kinetic energy produced upon a top-blown oxygen jet impinging against the bath surface. The term "dust" means scatters of fine particles entrained with a waste gas flow, the fine particles being produced upon abrupt volume expansion due to generation of CO gas resulted from the decarburization reaction.

The occurrence of splashes, dust and slopping is primarily dominated by the top-blown oxygen flow rate. However, because kinetic energy is lowered and volume expansion due to generation of CO gas is reduced under pressurization, the occurrence of dust and splashes is also suppressed under pressurization. To reduce the amount of dust and splashes generated, therefore, it is required to properly control not only pressure but also the top-blown oxygen flow rate, taking into account the relationship between both the factors. Further, the term "slopping" means a phenomenon attributable to such a situation that when the flow rate of top-blown oxygen becomes excessive, slag having an abnormally high content of (T·Fe) in non-equilibrium state is locally produced and is caught up into molten iron having a high carbon concentration, whereupon CO gas resulted from the decarburization reaction is explosively generated.

Since pressurizing the converter reduces the volume of CO gas generated, pressurization brings about an advantageous action in suppressing the slopping. From the basic point of view, however, the occurrence of slopping is primarily attributable to such a situation that slag having an abnormally high content of (T·Fe) in non-equilibrium state is produced due to imbalance between the flow rate of top-blown oxygen and the stirring intensity caused by bottom blowing. To suppress the occurrence of slopping, therefore, it is required to properly control not only pressure but also the top-blown oxygen flow rate and the bottom-blown gas flow rate for stirring, taking into account the relationship among those three factors.

Moreover, to improve the productivity during the period I, i.e., to carry out fast decarburization with an increased decarburization rate, it is required to increase the decarburization oxygen efficiency, i.e., the efficiency in utilization of top-blown oxygen gas for the decarburization reaction. During the period I, other than being utilized for the decarburization reaction, oxygen is consumed in the so-called post combustion with which CO gas generated upon the decarburization is oxidized to $CO_2$ in the inner space of the converter. The post combustion requires to be suppressed because the post combustion raises the temperature of waste gas and gives rise to much wear of the refractory.

Since the post combustion occurs through such a mechanism that oxygen dispersed from the outer periphery of a top-blown oxygen jet reacts with CO gas in the inner space of the converter, controlling the intensity of the oxygen jet is important for holding low the post combustion rate. Pressurization increases energy attenuation of top-blown oxygen and lowers energy of the top-blown oxygen reaching the bath surface. In addition, under pressurization, the top-blown oxygen flow rate, the shape of top-blown lance nozzle, and oxygen back pressure become dominating factors in the post combustion. It is therefore essential to control the top-blown oxygen flow rate, the impingement energy of the top-blown oxygen against bath surface, the lance nozzle shape, and the oxygen back pressure depending on changes in pressure.

Thus, for suppressing the occurrence of dust, splashes and slopping, maintaining high yield of molten steel, and holding low the post combustion rate, as well as improving the productivity during the period I, it is essential that the top-blown oxygen flow rate and the bottom-blown gas flow rate be adjusted depending on changes of the converter internal pressure, as defined in Claim 1.

As a result of thorough studies conducted by the inventors, it was found that changes of the bottom-blow stirring conditions caused by changes of the converter internal pressure affect decarburization blowing during the period I to a greater extent than thought in the past. Stated otherwise, in the case of bottom-blow stirring, an increase of the converter internal pressure deteriorates the decarburization characteristic to a much greater extent than the effect simply estimated from the indexes $\epsilon$, $\tau$ and BOC shown in the above formulae (1) to (3). The reason is that those indexes are employed to calculate work of bubble expansion due to the static pressure difference between the bath surface and the converter bottom, i.e., the gas blowing position, but the decarburization characteristic is in fact mainly dominated by how stirring is developed in the molten steel surface where the decarburization reaction occurs.

Bubbles 13 blown in into the bath of molten iron 11 gradually expand while moving upward, and the diameter of each bubble also gradually increases with expansion. In order that the individual adjacent bubbles are allowed to expand without joining with each other, a bubble rising area 12 is required to gradually widen laterally (FIG. 1). If the adjacent bubbles are joined with each other, the bubble diameter is further increased and the floating speed of the bubbles is accelerated. Accordingly, the bubble rising area 12 cannot increase its width and the bubble diameter continues increasing more and more, causing the bubbles to reach the surface in explosive fashion. On the other hand, if the bubble rising area 12 can increase its width, the adjacent bubbles are kept from joining with each other, and the bubble diameter is maintained at a stable bubble diameter balanced in point of static pressure. Accordingly, the floating speed of the bubbles is held low and the bubbles 13 float slowly. Whether the bubbles are joined with each other or the bubble rising area widens laterally is determined depending on the relationship between floatage energy and surface tension energy.

Figure 2:
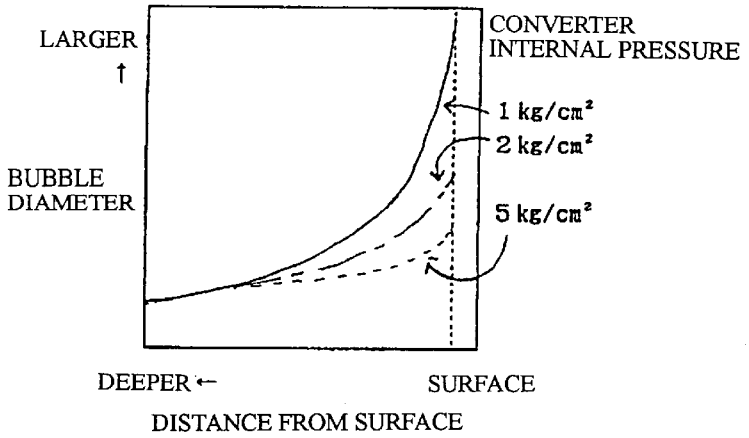
[FIG. 2] is a graph of experimental results (water model) for bubbles blown into the bath, showing an effect of the converter internal pressure upon the relationship between the depth from the bath surface and the diameter of bubbles.

From basic experiments, the inventors obtained characteristic curves representing changes of the bubble diameter as shown in FIG. 2. More specifically, it was found that the critical condition as to whether the bubbles are joined with each other or the bubble rising area widens laterally is greatly affected by static pressure near the surface, and if the converter internal pressure is increased above 1 kg/cm$^2$, the bubble diameter is avoided from explosively increasing near the surface. An explosive increase of the bubble diameter near the surface greatly contributes to stirring of the molten steel surface, and greatly affects creation of slag having an abnormally high content of (T·Fe) in non-equilibrium state which induces the slopping. Such an explosive increase of the bubble diameter near the surface is difficult to estimate from calculations of $\epsilon$, $\tau$ and BOC, and can be suppressed only under control of F1/P1 and Q1/P1 proposed by the present invention.

Figure 3:
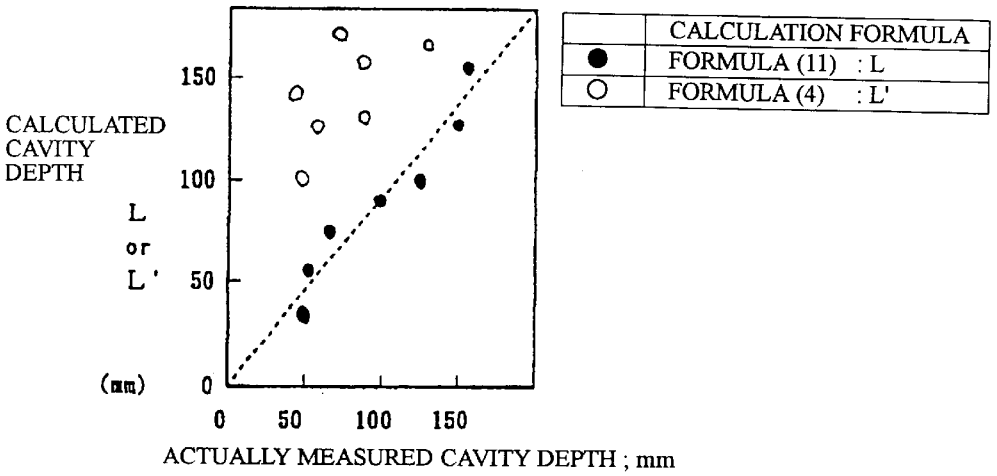
[FIG. 3] is a graph of experimental results (water model), showing comparison between actually measured values and calculated values of the cavity depth under pressurization.

Further, a phenomenon in which the decarburization oxygen efficiency by top blowing lowers with an increase of the converter internal pressure cannot be also estimated from the relationship with respect to L' and $(X-H_c)/d$ which have been conventionally employed, and can be estimated only by precisely evaluating the effect of pressure in a pressurized state based on the calculation formulae for the cavity depth L, shown as the above formulae (11) to (14), and controlling L/D. FIG. 3 shows the relationship among actually measured values of the cavity depth under pressurization, L calculated from the above formulae (11) to (14), and L' calculated from the above formula (4). As seen, L shows good correspondence to the measured values.

The behavior of a jet under pressurization is featured in that because of gas density being high at the periphery of the jet, as the length of a supersonic core is shortened, the jet spreads to a larger extent and therefore a larger amount of surrounding CO gas is caught up into the oxygen jet. Additionally, the reaction of $2CO+O_2=2CO_2$ tends to progress more speedily under pressurization, thus resulting in a state in which post combustion is very likely to occur. Under pressurization, therefore, the post combustion rate increases and the decarburization oxygen efficiency lowers unless the cavity depth is precisely controlled.

Figure 4:
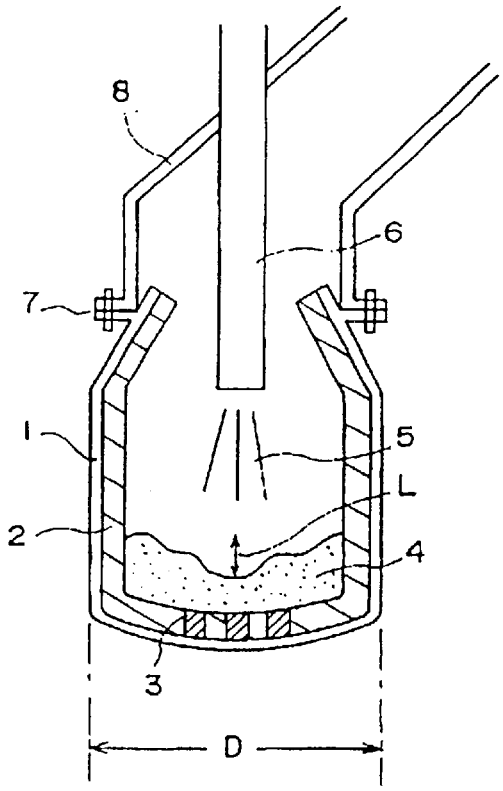
[FIG. 4] is a schematic view showing an embodiment of the present invention. A waste gas duct 8 is coupled to a pressure-adjusting device through a dust collector and a gas-cooling device.

FIG. 4 schematically shows an embodiment of the present invention. Referring to FIG. 4, numeral 1 denotes a converter shell, 2 denotes an interiorly lined refractory, 3 denotes a bottom-blow tuyere, 4 denotes molten iron, 5 denotes an oxygen jet, 6 denotes a top-blow lance, 7 denotes a fastening device, 8 denotes a waste gas duct, and alphabet L denotes the cavity depth of the molten iron.

The reasons for restricting numeral values, etc. in constituent elements of the present invention are as follows.

The reason why the present invention is restricted to the operation of a top-and-bottom blowing converter in Claim 1 is that the stirring intensity by bottom blowing cannot be freely controlled in a top blown converter, and the oxygen flow rate and the stirring intensity by bottom blowing cannot be independently controlled in a bottom-blown converter because these two factors are generally in proportion to each other. While various kinds of bottom-blown gases and blowing methods are available in the top-and-bottom blowing converter, the bottom-blown gas for use in the present invention may comprise oxygen and LPG, oxygen and LPG added with one or more of inert gas, carbon dioxide and carbon monoxide, and one or more of inert gas, carbon dioxide and carbon monoxide, and the blowing method may be implemented with tuyere bricks using one or more of single pipes, slit pipes, annular pipes and double annular pipes, and porous bricks.

The term "pressurized converter" is defined as representing a converter of which internal pressure is set to a level higher than the atmospheric pressure during the whole or a part of the blowing period. The converter internal pressure is desirably not less than 1.2 kg/cm$^2$ from the standpoint of obtaining the advantage of pressurization, i.e., an improvement of the productivity, and is desirably not more than 5 kg/cm$^2$ for the reasons that a capital investment for equipment should be held at a necessary minimum, and if the pressure is too high, slag would be more apt to permeate in pores of the refractory under the high pressure and the refractory life would be reduced.

Claims 2 and 3 specify the operating conditions during the period I as with Claim 1. The period I is defined as a region where the steel bath carbon concentration; C is higher than 0.5%. The carbon concentration representing transition from the period I to the period II varies in the range of 0.2–0.5% depending on the stirring by bottom blowing and the top-blown oxygen flow rate. However, if the carbon concentration is not less than 0.5%, the steel bath is regarded as being in the period I where the decarburization rate is determined by the oxygen flow rate.

Furthermore, in Claim 10, the C concentration representing transition from the period I to the period II is defined using CB in the following formula (10) as being higher than the range of CB×0.6 to CB×1.8.

$$CB=0.078\times P+0.058\times F-1.3\times Q-0.00069\times Wm+0.49 \quad (10)$$

wherein

P: converter internal pressure (kg/cm$^2$)

F: top-blown oxygen flow rate (Nm$^3$/ton/min)

Q: bottom-blown gas flow rate (Nm$^3$/ton/min)

Wm: amount of molten steel (t)

CB represents the critical carbon concentration at which the decarburization reaction shifts from a region where the reaction rate is determined by the oxygen flow rate (the period I) to a region where the reaction rate is determined by the carbon transfer rate (the period II). Based on close experiments, the inventors constructed a new experimental formula describing CB under pressurization. In other words, the new experimental formula was derived as a linear multiple regression formula using the converter internal pressure P, the top-blown oxygen flow rate F, and the bottom-blown gas flow rate Q. A coefficient of Q, particularly, is large, which means, as described before, that bottom blowing affects the decarburization characteristic under pressurization to such a large extent that the effect cannot be estimated from the behavior under the atmospheric pressure.

If a lower limit of the carbon concentration for performing the control defined in Claims 2 and 3 is higher than CB×1.8, control would shift to the control that is to be inherently performed in the period II, by lowering the pressure and the supplied oxygen flow rate or increasing the bottom-blow stirring from a higher level of carbon concentration than necessary. This results in such problems that the productivity is deteriorated with an increase of the decarburization time, and the tuyere refractory is more damaged due to excessively strong stirring. Also, if the lower limit of the carbon concentration is lower than CB×0.6, the refining control to be inherently performed in the period I, i.e., the refining under excessively high pressure and supplied oxygen flow rate and too small stirring intensity, would be continued even after shift to the period II, thus bringing the molten steel into a superoxidated state.

According to Claim 2, F1/P1 is controlled to be held in the range of 1.1–4.8, and Q1/P1 is controlled to be held in the range of 0.05–0.35. These conditions specify conditions necessary for suppressing the occurrence of dust, splashes and slopping and maintaining high yield of the molten steel, as well as improving the productivity during the period I. The occurrence of dust and splashes is dominated by the pressure and the top-blown oxygen flow rate. By setting F1/P1 to be not more than 4.8, the occurrence of dust and splashes can be suppressed, and high yield of the molten steel can be obtained. If F1/P1 is less than 1.1, the occurrence of dust and splashes would be small, but this condition would no be practical because of a small decarburization rate and hence low productivity.

Figure 5:
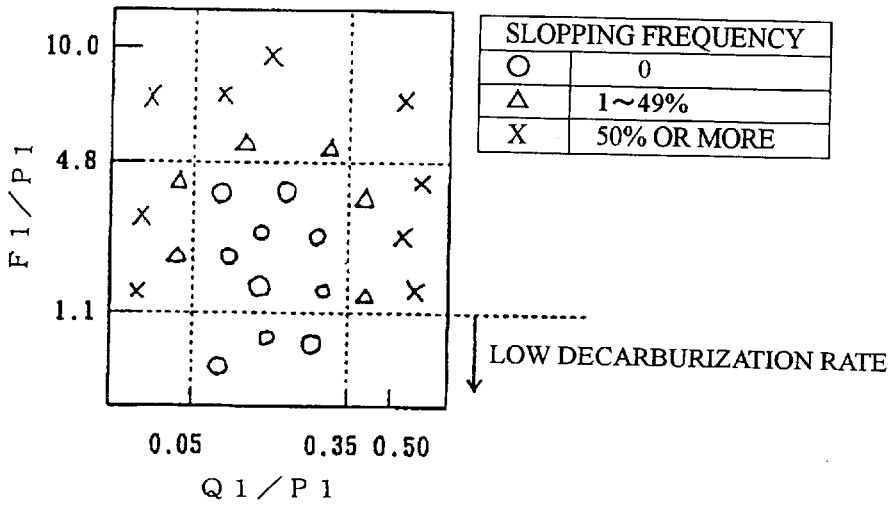
[FIG. 5] is a graph of experimental results, showing the relationship among slopping frequency, F1/P1, and Q1/P1.

To suppress slopping in fast decarburization, as shown in FIG. 5, it is required to control F1/P1 to be not more than 4.8 and Q1/P1 to be held in the range of 0.05–0.35. The occurrence of slopping is primarily attributable to such a situation that slag having an abnormally high content of (T.Fe) in non-equilibrium state is produced due to imbalance between the flow rate of top-blown oxygen and the stirring intensity caused by bottom blowing. Q1/P1 specifies the condition for the stirring intensity caused by bottom blowing. If Q1/P1 is less than 0.05, the stirring would be so small that the slopping is more likely to occur. If Q1/P1 is more than 0.35, creation of the slag having an abnormally high content of (T.Fe) in non-equilibrium state would be avoided, but excessively strong stirring would cause the steel bath to wave violently, thus resulting in a problem that slag and molten iron are scattered out of the converter due to waving of the steel bath.

F1/P1 specifies the oxygen flow rate. If F1/P1 is more than 4.8, creation of the slag having an abnormally high content of (T.Fe) in non-equilibrium state would not be avoided whatever stirring would be intensified, thus giving rise to slopping frequently. In particular, the fast decarburizing operation in the pressurized converter is enabled only based on the effect of pressure upon the relationship between stirring and slopping, which has been clarified by the inventors.

Figure 6:
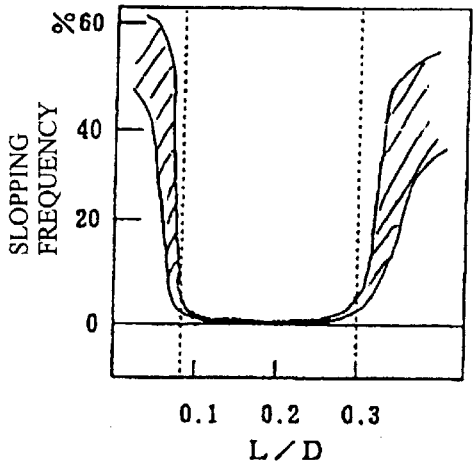
[FIG. 6] is a graph of experimental results, showing the relationship between slopping frequency and L/D.

According to Claim 3, a ratio (L/D) of the depth L of a cavity formed in the steel bath surface by the top-blown oxygen to the bath diameter D is controlled to be held in the range of 0.08–0.30. This condition also specifies a condition necessary for suppressing the occurrence of dust, splashes and slopping, maintaining low the post combustion rate, and increasing yield of the molten steel, as well as improving the productivity during the period I. More specifically, if (L/D) is less than 0.08, the intensity of the top-blown oxygen jet would be so small that, as shown in FIG. 6, the refractory is more damaged with an increase of the post combustion rate. In addition, the temperature at a top-blow hot spot (a high-temperature area which is formed upon the top-blown oxygen impinging against the bath surface) would be lowered, and creation of the slag having an abnormally high content of (T.Fe) in non-equilibrium state would not be avoided, thus giving rise to slopping frequently.

Conversely, if (L/D) is more than 0.30, the intensity of the top-blown oxygen jet would be so large that splashes occur more violently. Also, in this case, because the slag having a high content of (T.Fe) and produced at the hot spot in non-equilibrium state would be deeply caught up into the steel bath by downward forces generated by the top-blown jet, there would arise such a problem that the static pressure of the molten steel at the time of generation of CO gas is increased and the slopping is very likely to occur even with a low content of (T.Fe). The effect of pressure upon the cavity depth has not been clarified until being made by the inventors. The fast decarburizing operation in the pressurized converter is enabled only as a result of clarifying the quantitative relationship between the above effect and the post combustion rate and the condition under which the slopping occurs.

The methods (4)–(9), (11) and (12) according to the present invention will be described below in detail.

During the period II, control aims at suppressing superoxidation while maintaining high productivity, and it is important to control the pressure, the oxygen flow rate and the stirring intensity depending on changes of the carbon concentration. The decarburization rate (K; %C/min) in a region under the period II is expressed by the following formula.

$$K=dC/dt=(Ak/V)\cdot(C-C_O)$$

In this formula, C is the carbon concentration, t is time, A is the reaction interface area, k is the mass transfer coefficient of carbon, V is the volume of molten iron, and $C_O$. is the equilibrium carbon concentration. Increasing K requires an increase of A, k and a decrease of $C_O$. By top-blowing oxygen at a flow rate corresponding to the decarburization rate given by K, decarburization can be progressed in principle without causing neither oxidation of molten iron nor absorption of oxygen into molten steel.

In operation, it is required to apply bottom-blow stirring intensity corresponding to the carbon concentration for increasing the carbon transfer rate, to provide the oxygen flow rate in match with the stirring intensity, and to provide the top-blow hot spot (the high-temperature area which is formed upon the top-blown oxygen impinging against the bath surface) for proceeding the decarburization reaction efficiently. Here, the stirring by bottom blowing forms a macroscopic circulating flow in the bath, thereby increasing the carbon transfer rate and increasing the reaction interface area due to formation of an emulsion of slag and metal which is developed with floating of bottom-blow bubbles toward an area around the top-blow hot spot. Also, the top-blow hot spot forms a high-temperature state, thereby lowering the equilibrium carbon concentration and increasing the reaction interface area due to formation of an emulsion of slag and metal which is developed with the top-blown jet.

Applying pressure reduces the amount of increase in volume of the bottom-blown gas near the surface, and increases attenuation of energy of the top-blown oxygen jet, whereby the bottom-blow stirring intensity are reduced and the emulsion formation state is lessened. It is therefore required to properly control the bottom-blow stirring intensity, the energy of the top-blown oxygen jet, the oxygen flow rate, and the converter internal pressure in relation to the carbon concentration by quantitatively grasping the above phenomena as effects upon the reaction rate. In other words, for suppressing superoxidation of molten steel, and obtaining high yield and highly pure steel, as well as maintaining high productivity, it is essential as defined in Claim 4 that the top-blown oxygen flow rate, the bottom-blown gas flow rate, and the converter internal pressure be changed depending on a variation of the carbon concentration in the steel bath.

The reasons for restricting numeral values, etc. in constituent elements of the present invention are as follows.

The reason why the present invention is restricted to the operation of a top-and-bottom blowing converter in Claim 4 is that the stirring intensity by bottom blowing cannot be freely controlled in a top blown converter, and the oxygen flow rate and the stirring intensity by bottom blowing cannot be independently controlled in a bottom-blown converter because these two factors are generally in proportion to each other. While various kinds of bottom-blown gases and blowing methods are available in the top-and-bottom blowing converter, the bottom-blown gas for use in the present invention may comprise oxygen and LPG, oxygen and LPG added with one or more of inert gas, carbon dioxide and carbon monoxide, and one or more of inert gas, carbon dioxide and carbon monoxide, and the blowing method may be implemented with tuyere bricks using one or more of single pipes, slit pipes, annular pipes and double annular pipes, and porous bricks.

The term "pressurized converter" is defined as representing a converter of which internal pressure is set to a level higher than the atmospheric pressure during the whole or a part of the blowing period. The converter internal pressure is desirably not less than 1.2 kg/cm$^2$ to achieve the advantage of improving the productivity under pressurization, and is desirably not more than 5 kg/cm$^2$ for the reasons that a capital investment for equipment should be held at a necessary minimum, and if the pressure is too high, slag would be more apt to permeate in pores of the refractory under the high pressure and the refractory life would be reduced. Furthermore, during the period II, the term "pressurized converter" is defined as including the case in which the pressure is reduced from the pressurized state with a lowering of the carbon concentration by dropping the pressure in continuous or stepwise manner for shift to the operation under the atmospheric pressure or light depressurization not less than 0.9 kg/cm$^2$ for suction of the waste gas.

Claims 5 to 8 specify the operating conditions during the period II as with Claim 4. The carbon concentration range specifying the operating conditions during the period II is defined as a range where C is lower than 1%. The carbon concentration representing transition from the period I to the period II varies in the range of 0.2–0.5% as mentioned before. In order to achieve blowing to suppress superoxidation during the period II, however, it is not sufficient to only properly set the blowing conditions during the period II, and it is required to select the proper blowing conditions from a range of higher carbon concentration. Based on close experiments, the inventors found that the critical carbon concentration for such a range is 1%.

In Claim 11, the carbon concentration range specifying the operating conditions during the period II is defined using CB in the above formula (10) as being lower than the range of CB×0.6 to CB×1.8.

As described above, CB represents the critical carbon concentration at which the decarburization reaction shifts from a region where the reaction rate is determined by the oxygen flow rate (the period I) to a region where the reaction rate is determined by the carbon transfer rate (the period II). Based on close experiments, the inventors constructed a new experimental formula describing CB under pressurization.

If an upper limit of the C concentration for starting the control defined in Claims 5 to 9 is higher than CB×1.8, control would shift to the control that is to be inherently performed in the period II, from a higher level of carbon concentration than necessary. This results in such problems that the productivity is deteriorated with an increase of the decarburization time, and the tuyere refractory is more damaged. Also, if the upper limit of the C concentration is lower than CB×0.6, the refining control to be inherently performed in the period I would be continued even after shift to the period II, thus bringing the molten steel into a superoxidated state.

Figure 7:
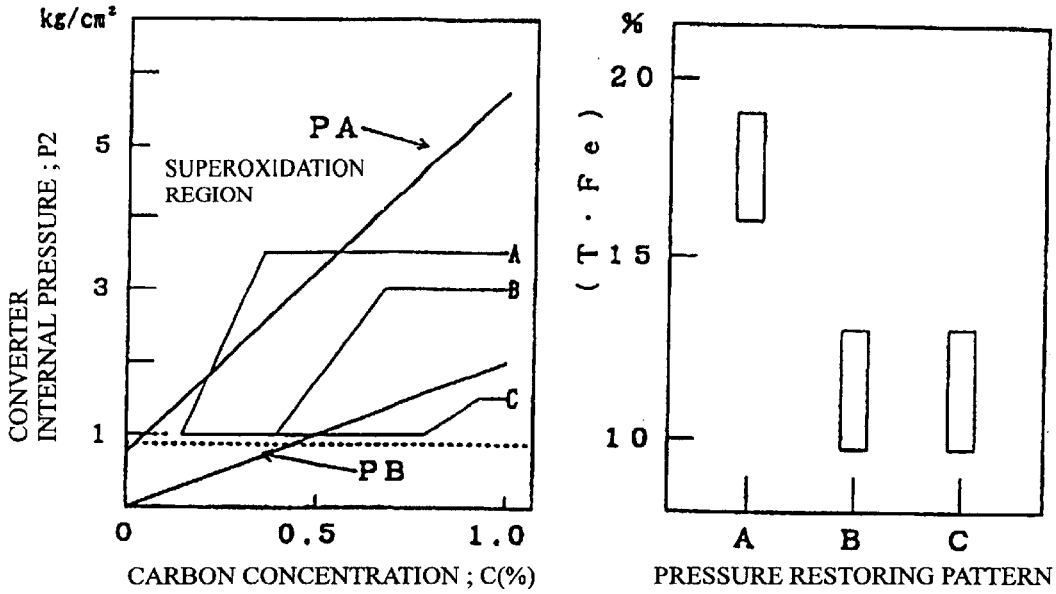
[FIG. 7] is a graph of experimental results, showing the relationship among a carbon concentration C, a converter internal pressure P2, and (T·Fe) at the end of blowing.

Claim 5 specifies control of the converter internal pressure P2 depending on a variation of the carbon concentration C. As shown in FIG. 7, P2 is controlled to be held in a range between PA defined by the following formula (5) and PB defined by the following formula (6).

$$PA=0.8+5\times C \quad (5)$$

$$PB=2\times C \quad (6)$$

In these formulae, the unit of C is wt% and the unit of both PA, PB is (kg/cm$^2$). Mismatch in unit gives rise to no problems.

To carry out refining at a high oxygen flow rate for increasing the productivity, it is preferable to set the pressure to a higher level. Higher pressure however reduces the stirring intensity by bottom blowing and the energy of the top-blown oxygen jet, thereby reducing the reaction interface area and the mass transfer coefficient of carbon. As a result of studying a quantitative optimum pressure change pattern in consideration of those relationships, the above formulae (5) and (6) have been derived.

Stated differently, the decarburization reaction with the top-blown oxygen is a reaction between FeO produced at the hot spot and carbon in the steel bath. Because FeO produced at the hot spot is always pure FeO regardless of the carbon concentration and pressure, the reaction rate is determined only by the carbon concentration. At high carbon, therefore, the reaction rate is so fast that the nucleation speed of CO bubbles cannot follow the reaction, large CO bubbles are produced, and splashes are violently scattered due to rupture of the CO bubbles. Accordingly, in the case of the carbon concentration being high, the pressure requires to be set to a higher level. Conversely, if the pressure is increased in a state in which the carbon concentration is lowered, splashes are lessened, but the decarburization rate is reduced due to an increase of the equilibrium carbon concentration $C_O$.

More specifically, if the converter internal pressure P2 is higher than PA, this means that the timing of restoring the pressure is too late. In such a condition, the equilibrium carbon concentration $C_O$ would be increased, the decarburization rate would be reduced, and excessive oxygen would oxidize molten iron or would be dissolved in molten steel, thereby increasing (T.Fe) of slag or the oxygen concentration in the molten steel. Also, if the converter internal pressure P2 is less than PB, this means that the timing of restoring the pressure is too early. In such a condition, because of the pressure being restored to the state of the period I or close to the same, violent splashes would occur. Further, if the pressure is restored in the state in which the carbon concentration is high, there would arise such a problem that the high carbon concentration in the molten steel increases the reaction of carbon with (T.Fe) (iron oxides in slag), whereby CO gas is violently generated and the slopping is very likely to occur even with a low content of (T.Fe).

Claim 6 specifies control of the top-blown oxygen flow rate F2 depending on the carbon concentration C in addition to the control of the converter internal pressure P2 depending on a variation of the carbon concentration C which is specified in Claim 5. The top-blown oxygen flow rate F2 in the region where C is not more than 1% is controlled with respect to the top-blown oxygen flow rate F1 in the region where C is more than 1%, so that β expressed by the following formula (7) is held in the range of −0.25 to 0.5.

$$\beta=(F2/F1)-C \quad (7)$$

Figure 8A:
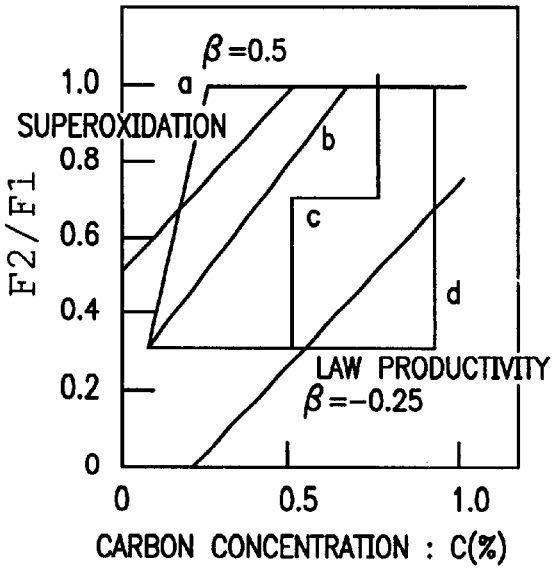
[FIGS. 8(A) and 8(B)] are graphs of experimental results, showing the relationship among an oxygen flow rate F2, a parameter β determined by the carbon concentration C, and (T·Fe) at the end of blowing.
Figure 8B:
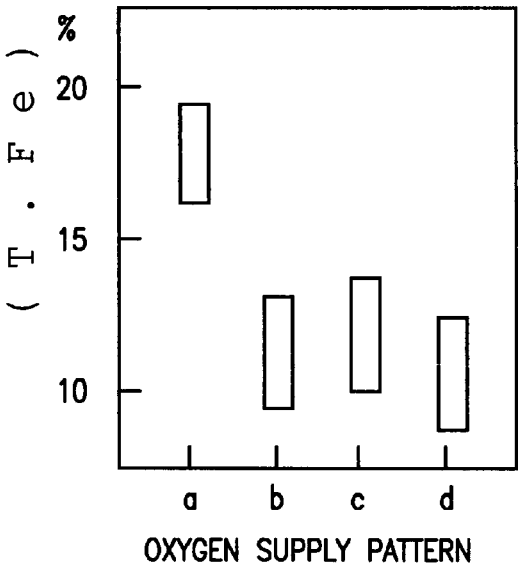

More specifically, for improving the productivity, it is preferable to set the oxygen flow rate to a higher level. However, if oxygen is supplied in an excessive amount relative to the decarburization rate that depends on the stirring intensity by bottom blowing, the reaction interface area A determined by the energy of the top-blown oxygen jet, and the mass transfer coefficient k of carbon, the degree of superoxidation would be increased and (T·Fe) of slag or the oxygen concentration in the molten steel would be increased. Based on close experiments made by the inventors, it was found that, on the premise of the pressure control defined in Claim 5, β requires to be held in the range of −0.25 to 0.5 as shown in FIGS. 8(A) and 8(B). If β is less than −0.25, superoxidation would be suppressed due to a too much lowering of the oxygen flow rate, but the productivity would be reduced with a remarkable increase of the oxygen blowing time. If β is more than 0.5, superoxidation would occur due to a too small lowering of the oxygen flow rate, thereby increasing (T·Fe) of slag or the oxygen concentration in the molten steel.

Claim 7 specifies control of the bottom-blown gas flow rate Q2 depending on a variation of the carbon concentration C in addition to the control of the converter internal pressure P2 depending on a variation of the carbon concentration C which is specified in Claim 5. The bottom-blown gas flow rate Q2 in the region where C is not more than 1% is controlled with respect to the bottom-blown gas flow rate Q1 in the region where C is more than 1%, so that γ expressed by the following formula (8) is held in the range of −2 to 1.

$$\gamma=(Q2/Q1)-5\times(1-C) \quad (8)$$

Figure 9A:
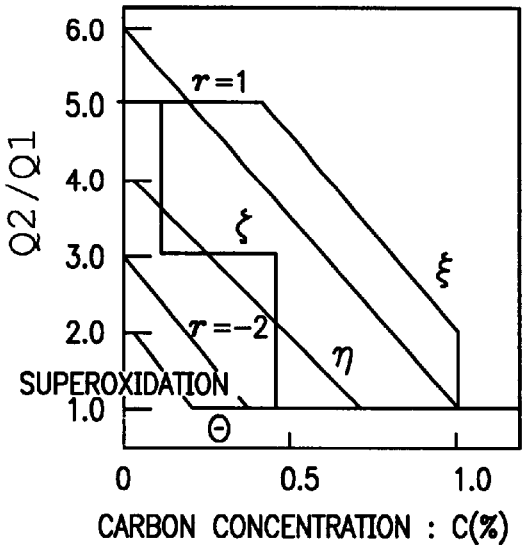
[FIGS. 9(A) and 9(B)] are graphs of experimental results, showing the relationship among a bottom-blown gas flow rate Q2, a parameter γ determined by the carbon concentration C, and (T·Fe) at the end of blowing.
Figure 9B:
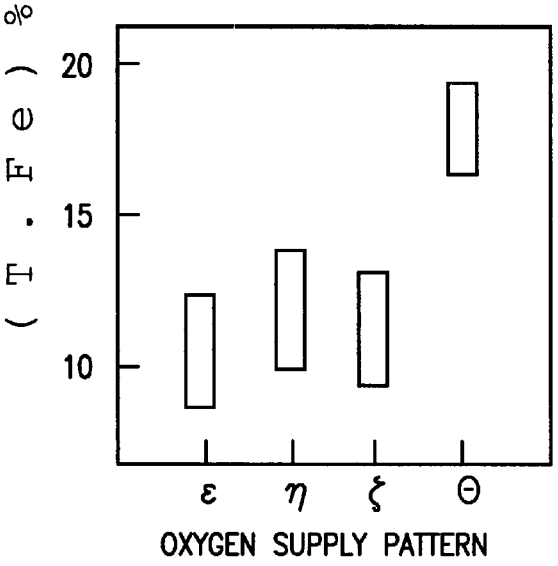

More specifically, the greater stirring intensity by bottom blowing improves the productivity because the decarburization rate depending on the mass transfer coefficient k of carbon is increased. However, if the stirring intensity by bottom blowing were excessively increased, there would arise problems of increasing the bottom-blown gas cost and reducing the refractory life. Based on close experiments made by the inventors, it was found that, on the premise of the pressure control defined in Claim 5, γ requires to be held in the range of −2 to 1 as shown in FIGS. 9(A) and 9(B).

If γ is less than −2, the oxygen flow rate would be excessive and superoxidation would occur due to a too small increase of the stirring intensity by bottom blowing corresponding to a lowering of the carbon concentration, thereby increasing (T.Fe) of slag or the oxygen concentration in the molten steel. If γ is more than 1, the stirring intensity in the region where the carbon concentration is low would be so strong that the bottom-blown gas cost is increased and the refractory life is reduced. Additionally, there would occur such a problem that the steel bath is forced to wave violently, and slag and molten iron are scattered out of the converter due to waving of the steel bath.

As a result of thorough studies conducted by the inventors, it was found that changes of the bottom-blow stirring conditions caused by changes of the converter internal pressure affect decarburization blowing during the period II to a greater extent than thought in the past. Stated otherwise, in the case of bottom-blow stirring, an increase of the converter internal pressure deteriorates the decarburization characteristic to a much greater extent than the effect simply estimated from the indexes ε, τ and BOC shown in the above formulae (1) to (3). The reason is, as described above in connection with the period I, that those indexes are employed to calculate work of bubble expansion due to the static pressure difference between the bath surface and the converter bottom, i.e., the gas blowing position, but the decarburization characteristic is in fact mainly dominated by how stirring is developed in the molten steel surface where the decarburization reaction occurs.

As already described above in connection with the period I with reference to FIGS. 1 and 2, it was found that the critical condition as to whether the bubbles are joined with each other or the bubble rising area widens laterally is greatly affected by static pressure near the surface, and if the converter internal pressure is increased above 1 kg/cm$^2$, the bubble diameter is avoided from explosively increasing near the surface. An explosive increase of the bubble diameter near the surface greatly contributes to stirring of the molten steel surface, and greatly affects an increase of the reaction interface area due to formation of an emulsion of slag and metal which is developed with floating of bottom-blow bubbles toward the area around the top-blow hot spot as mentioned above. As with the period I, such an explosive increase of the bubble diameter near the surface is difficult to estimate from calculations of ε, τ and BOC, and can be suppressed only under control of γ proposed by the present invention.

Claim 8 specifies conditions for permitting most effective refining in view of the correlation among the converter internal pressure P2, the top-blown oxygen flow rate F2, and the bottom-blown gas flow rate Q2 depending on a variation of the carbon concentration C. Control is performed so that δ expressed by the following formula (9) is held in the range of 5 to 25.

$$\delta=\{(F2\times P2)/Q2\}^{1/2}/C \quad (9)$$

Figure 10:
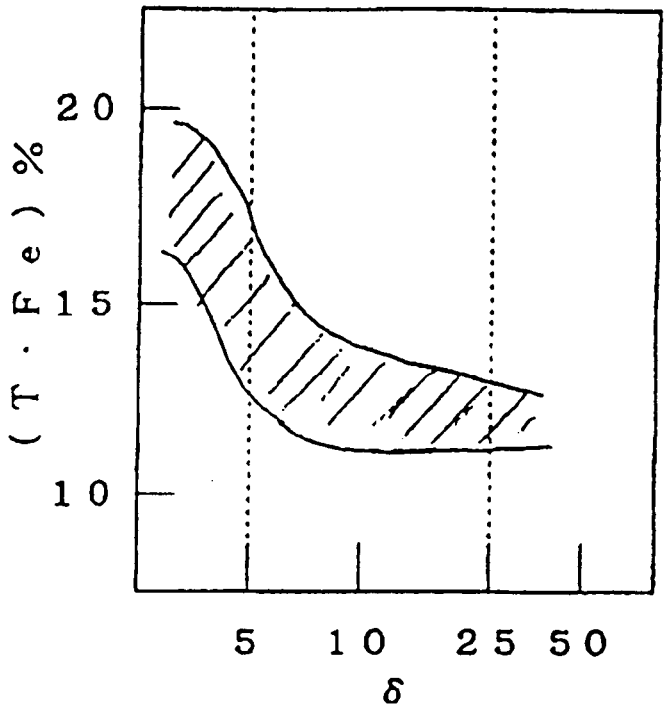
[FIG. 10] is a graph of experimental results, showing the relationship between a parameter δ, which is determined by the converter internal pressure P2, the oxygen flow rate F2, the bottom-blown gas flow rate Q2 and the carbon concentration C, and (T·Fe) at the end of blowing.

As already described in detail, in the operation of the pressurized converter during the period II, high productivity, high yield, and high purity of the molten steel resulted from suppressing superoxidation can be achieved only by properly controlling four factors, i.e., the carbon concentration C, the converter internal pressure P2, the top-blown oxygen flow rate F2 and the bottom-blown gas flow rate Q2. Based on close experiments made by the inventors, it was found that δ requires to be held in the range of 5 to 25 as shown in FIG. 10. The rate of the decarburization reaction during the period II is determined by the mass transfer rate of carbon. This means that the reaction progresses through such an elementary process that FeO produced upon oxidation by the top-blown oxygen is reduced by carbon in the molten steel. Because reduction is slower than oxidation, the reaction rate is determined by the mass transfer rate of carbon which dominates the reduction speed.

The above formula (9) was derived in consideration of such an elementary process. The numerator $(F2\times P2)^{1/2}$ represents an oxidation index in consideration of the pressure, and the denominator $(Q2^{1/2}\times C)$ represents a reduction index in consideration of the carbon concentration. Putting the pressure in the oxidation index has not been thought until being clarified by the inventors, and has the meaning as follows. When the pressure is increased, partial pressure of oxygen gas at the reaction interface is increased in spite of the same oxygen flow rate, and therefore the oxygen potential is increased in proportion to the pressure. This indicates that even when the interior of the converter is pressurized by gas other than oxygen, partial pressure of oxygen gas reaching the reaction interface is itself increased. Such a phenomenon has been in no way taken into consideration. The operation of the pressurized converter is enabled only by introducing that index.

If δ is less than 5, the reduction rate would be so much greater than the oxidation rate that superoxidation is suppressed, but the productivity would be reduced with a remarkable increase of the oxygen blowing time. If δ is more than 25, the oxidation rate would be so much greater than the reduction rate that superoxidation occurs, thus increasing (T.Fe) of slag or the oxygen concentration in the molten steel.

The feature of Claim 9, in which a ratio (L/D) of the depth L of a cavity formed in the steel bath surface by the top-blown oxygen to the bath diameter D is controlled to be held in the range of 0.15–0.35, also specifies a condition necessary for suppressing superoxidation while improving the productivity during the period II. The cavity depth is one of indexes representing the energy of the top-blown oxygen jet, and the top-blown oxygen jet develops two effects. One effect is to form a high-temperature hot spot, and the other effect is to form a violent emulsion for applying strong downward energy to the steel bath surface.

More specifically, if (L/D) is less than 0.15, the energy of the top-blown oxygen jet would be so small that the temperature of the hot spot is lowered and the emulsion area is reduced, thereby giving rise to superoxidation. Conversely, if (L/D) is more than 0.35, the energy of the top-blown oxygen jet would be so great that splashes occur violently, thus leading to a problem in operation. Also, since FeO produced at the hot spot is suspended down to a deep position of the steel bath and is subjected to large static pressure, the reducing reaction becomes hard to progress and the decarburization reaction rate is rather lowered.

The behavior of a jet under pressurization is featured in that because of gas density being high at the periphery of the jet, as the length of a supersonic core is shortened, the jet spreads to a much larger extent due to increasing resistance developed by gas around the jet. Accordingly, the shape of the cavity formed by the top-blown jet under pressurization is drastically changed to such an extent that the change cannot be estimated from a change attributable to, e.g., vertical movement of the lance under the atmospheric pressure. Thus efficient refining is enabled only by performing control based on precise values derived as in the present invention.

According to Claim 12, after the steel bath carbon concentration; C has entered a region corresponding to the range of CB×0.6 to CB×1.8, CB being expressed by the above formula (10), the converter internal pressure P, the top-blown oxygen flow rate F, and the bottom-blown gas flow rate Q are controlled so that CB expressed by the above formula (10) is held in the range of C×0.6 to C×1.8. The range of C allowing start of the control is specified on the basis of the same concept as defined in Claim 11.

The reason why the control is performed based on the formula (10) is that the formula (10) is a formula describing the critical carbon concentration at which the decarburization reaction shifts from a region where the reaction rate is determined by the oxygen flow rate (the period I) to a region where the reaction rate is determined by the carbon transfer rate (the period II). In other words, by controlling one or two or more of P, F and Q so that the carbon concentration in steel is always held at CB, the operation does not enter the period II, superoxidation of the molten steel is avoided, and a maximum carburization rate is obtained, thus providing high productivity. If the above control is performed in a range of carbon concentration higher than CB×1.8, refining is carried out with the more intent to prevent superoxidation than necessary by lowering the pressure and the supplied oxygen flow rate or increasing the bottom- blow stirring. This results in such problems that the productivity is deteriorated with an increase of the decarburization time, and the tuyere refractory is more damaged due to excessively strong stirring. Also, if the above control is performed in a range of carbon concentration lower than CB×0.6, the refining control in the period I, i.e., the refining under excessively high pressure and supplied oxygen flow rate and too small stirring intensity, would be continued even after shift to the period II, thus bringing the molten steel into a superoxidated state.

EXAMPLES

An experimental test was made using a 5-ton scaled test converter. A top-blow lance comprised a Laval nozzle lance having 3–6 nozzles with the throat diameter changed from 5 to 20 mm, and two tuyeres each formed of an annular pipe, which comprised an inner pipe for introducing oxygen and an outer pipe for introducing LPG, were installed at the converter bottom for bottom blowing. Waste gas was introduced in a not-combustion state to a dust collecting system through a water cooling hood connected to the top of the converter, and the internal pressure of the converter was adjusted by a pressure regulating valve provided midway. Nitrogen gas was introduced for forced pressurization at the beginning of blowing, but a pressurized state was maintained by self-pressurization with generated CO and $CO_2$ in most of the oxygen blowing time.

The temperature was measured using a sub-lance. The carbon concentration was estimated based on a result of intermediate sampling analysis using the sub-lance, the amount of waste gas, and the composition of waste gas. Situations of slopping and spitting were judged based on images picked up by a monitoring camera watching inside the converter. The amount of generated dust was evaluated by weighing the total amount of dust recovered by a dust collector and was also evaluated based on a value (kg/t/Δ[% C]) resulted from dividing the amount of dust (kg/t) generated per unit amount of molten steel by the amount of decarburization (Δ[% C]).

Molten pig iron was prepared after being subjected to smelting in a blast furnace and then to the hot metal pretreatment process. Components of the molten pig iron were about 4.3% of C, about 0.12% of Si, about 0.25% of Mn, about 0.02% of P, and about 0.015% of S. About 5 tons of the molten pig iron was employed, and the temperature of the molten pig iron prior to charging into the converter was about 1300° C. In the following Example 1 to Comparative Example 3, the carbon concentration at the end of blowing was about 0.6% and the temperature at the end of blowing was about 1580° C. Also, in the following Example 4 to Comparative Example 8, the carbon concentration at the end of blowing was about 0.05% and the temperature at the end of blowing was about 1650° C.

Example 1

In Example 1, F1/P1 was controlled to 3 and Q1/P1 was controlled to 0.2 by changing the top-blown oxygen flow rate (F1) in the range of 4.5–7.5 $Nm^3$/ton/min and the bottom-blown gas flow rate (Q1) in the range of 0.3–0.5 $Nm^3$/ton/min corresponding to changes of the converter internal pressure (P1) in the range of 1.5–2.5 kg/$cm^2$. Also, by properly setting the lance height, the nozzle diameter, and the number of nozzles, the ratio (L/D) of the cavity depth to the bath diameter was held in the range of 0.12–0.24. As a result, stable decarburization refining was carried out without causing slopping and waving of the bath surface, and the amount of generated dust was as small as 2.2 kg/t/Δ[%C]. The decarburization oxygen efficiency was 93% and the post combustion rate was 5%.

Example 2

In Example 2, F1/P1 was controlled to 3.5 and Q1/P1 was controlled to 0.27 by changing the top-blown oxygen flow rate (F1) in the range of 3.5–9.5 $Nm^3$/ton/min and the bottom-blown gas flow rate (Q1) in the range of 0.2–0.8 $Nm^3$/ton/min corresponding to changes of the converter internal pressure (P1) in the range of 1.1–3.2 kg/$cm^2$. Also, by properly setting the lance height, the nozzle diameter, and the number of nozzles, the ratio (L/D) of the cavity depth to the bath diameter was held in the range of 0.19–0.26. As a result, stable fast decarburization refining was carried out without causing slopping and waving of the bath surface, and the amount of generated dust was as small as 2.1 kg/t/Δ[%C]. The decarburization oxygen efficiency was 95% and the post combustion rate was 4%.

Comparative Example 3

In Example 3, F1/P1 was controlled to 0.8 and Q1/P1 was controlled to 0.03 by changing the top-blown oxygen flow rate (Fl) in the range of 1.5–3.5 $Nm^3$/ton/min and the bottom-blown gas flow rate (Q1) in the range of 0.05–0.15

$Nm^3$/ton/min corresponding to changes of the converter internal pressure (P1) in the range of 1.5–2.5 kg/$cm^2$. Also, by properly setting the lance height, the nozzle diameter, and the number of nozzles, the ratio (L/D) of the cavity depth to the bath diameter was held in the range of 0.12–0.24. As a result, slopping occurred frequently and stable decarburization refining was not carried out. The amount of generated dust was 5.6 kg/t/Δ[%C], the decarburization oxygen efficiency was 84% and the post combustion rate was 15%.

Next, examples of the methods (4) to (9) according to the present invention will be described.

Conditions and results of Examples and Comparative Examples are listed in Table 1.

TABLE 1

| | P2 vs C relation | F2/F1 vs C relation | Q2/Q1 vs C relation | δ | L/D | End of blowing T-Fe % | End of blowing oxygen ppm | Molten steel yield % | Decarburization time min | Remarks | Rating |
|---|---|---|---|---|---|---|---|---|---|---|---|
| Ex. | | | | | | | | | | | |
| 4 | B | c | ζ | 7–20 | 0.20–0.30 | 12.0 | 400 | 95.5 | 6.1 | Stable operation | ⊙ |
| 5 | B | c | ζ | 3–15 | 0.20–0.30 | 12.4 | 425 | 95.4 | 8.1 | Stable operation | ○ |
| 6 | B | c | ζ | 12–35 | 0.20–0.30 | 14.3 | 565 | 94.1 | 7.2 | Stable operation | ○ |
| Com. Ex. | | | | | | | | | | | |
| 7 | A | a | ζ | 18–45 | 0.20–0.30 | 21.0 | 850 | 93.5 | 6.1 | Slopping occurred | x |
| 8 | C | d | ζ | 2–10 | 0.20–0.30 | 12.8 | 405 | 95.5 | 14.5 | Low productivity | x |

In Example 4, the pressure, the carbon concentration, the oxygen flow rate, and the bottom-blown gas flow rate were controlled in accordance with the relations denoted by B, c and ξ shown in FIGS. 7 to 9(B). Both δ and L/D were held respectively in the proper range of 7–20 and 0.20–0.30. As a result, (T·Fe) in slag and the dissolved oxygen concentration at the end of blowing were low, and the yield of molten steel was high. The refining was carried out with converter blowing in a short time of only 6.1 minutes without causing slopping.

In Comparative Example 7 corresponding to Example 4, the pressure, the carbon concentration and the oxygen flow rate were controlled in accordance with the relations denoted by A and a shown in FIGS. 7, 8(A) and 8(B). L/D was held in the proper range of 0.20–0.30, but δ was in the range of 18–45. As a result, in spite of carrying out high-speed oxygen blowing, (T·Fe) and the dissolved oxygen concentration at the end of blowing were high, the yield of molten steel was low, and slopping occurred.

In Comparative Example 8 corresponding to Example 4, the pressure, the carbon concentration and the oxygen flow rate were controlled in accordance with the relations denoted by C and d shown in FIGS. 7, 8(A) and 8(B). L/D was held in the proper range of 0.20–0.30, but δ was in the range of 2–10. As a result, (T·Fe) and the dissolved oxygen concentration at the end of blowing were low, and the yield of molten steel was high. However, the oxygen supply time was long and the advantage of improving the productivity under pressurization was not obtained.

INDUSTRIAL APPLIBILITY

The present invention made it possible, in a pressurized converter, to blow molten steel having a low degree of superoxidation with high productivity and high yield, and to produce low-carbon, highly-pure steel.

What is claimed is:

1. A pressurized converter steelmaking method for use in a top-and-bottom blowing converter, which comprises setting a converter internal pressure P in kg/$cm^2$ to a higher level than the atmospheric pressure, and adjusting a top-blown oxygen flow rate F in $Nm^3$/ton/min and a bottom-blown gas flow rate Q in $Nm^3$/ton/min depending on changes of the converter internal pressure P to maintain the converter internal pressure at a higher level than the atmospheric pressure.

2. A pressurized converter steelmaking method for use in a top-and-bottom blowing converter, which comprises setting, in a region in which a steel bath carbon concentration is higher than 0.5 wt %, a converter internal pressure P1 in kg/$cm^2$ to a higher level than the atmospheric pressure, and controlling a top-blown oxygen flow rate F1 in $Nm^3$/ton/min and a bottom-blown gas flow rate Q1 in $Nm^3$/ton/min to hold F1/P1 in the range of 1.1–4.8 and Q1/P1 in the range of 0.05–0.35.

3. A pressurized converter steelmaking method, wherein a lower limit of the steel bath carbon concentration for performing the control defined in claim 2 is held in the range of CB×0.6 to CB×1.8, CB being expressed by the following formula (10):

$$CB=0.078\times P+0.058\times F-1.3\times Q-0.00069\times Wm+0.49 \quad (10)$$

wherein

P: converter internal pressure in kg/$cm^2$

F: top-blown oxygen flow rate in $Nm^3$/ton/min

Q: bottom-blown gas flow rate $Nm^3$ton/min

Wm: amount of molten steel in tons.

4. A pressurized converter steelmaking method according to claim 1 or 2, wherein a ratio L/D of a depth L in m of a cavity formed in the steel bath surface by top-blown oxygen to a bath diameter D in m is controlled to be held in the range of 0.08–0.3.

5. A pressurized converter steelmaking method, wherein a lower limit of the steel bath carbon concentration for performing the control defined in claim 4 is held in the range of CB×0.6 to CB×1.8, CB being expressed by the following formula (10):

$$CB=0.078\times P+0.058\times F-1.3\times Q-0.00069\times Wm+0.49 \quad (10)$$

wherein

P: converter internal pressure in $kg/cm^2$

F: top-blown oxygen flow rate in $Nm^3/ton/min$

Q: bottom-blown gas flow rate in $Nm^3/ton/min$

Wm: amount of molten steel in tons.

6. A pressurized converter steelmaking method for use in a top-and-bottom blowing converter, which comprises setting a converter internal pressure P in $kg/cm^2$ to a higher level than the atmospheric pressure during the whole or a part of a blowing period, and changing a top-blown oxygen flow rate F in $Nm^3/ton/min$, a bottom-blown gas flow rate Q in $Nm^3/ton/min$ and the converter internal pressure P depending on a steel bath carbon concentration C in wt %.

7. A pressurized converter steelmaking method according to claim 6, wherein in a region in which the steel bath carbon concentration C is not higher than 1 wt %, the converter internal pressure P2 is controlled to be held in a range between PA defined by the following formula (5) and PB defined by the following formula (6):

$$PA=0.8+5\times C \quad (5)$$

$$PB=2\times C \quad (6).$$

8. A pressurized converter steelmaking method according to claim 2, wherein β in the following formula (7) is expressed using a ratio between the top-blown oxygen flow rate F1 in $Nm^3/ton/min$ in a region in which C is higher than 1%, and the top-blown oxygen flow rate F2 in a region in which C is not higher than 1%, and β is controlled to be held in the range of −0.25 to 0.5:

$$\beta=(F2/F1)-C \quad (7).$$

9. A pressurized converter steelmaking method according to claim 7, wherein γ in the following formula (8) is expressed using a ratio between the bottom-blown gas flow rate Q1 in $Nm^3/ton/min$ in a region in which C is higher than 1%, and the bottom-blown gas flow rate Q2 in a region in which C is not higher than 1%, and γ is controlled to be held in the range of −2 to 1:

$$\gamma=(Q2/Q1)-5\times(1-C) \quad (8).$$

10. A pressurized converter steelmaking method according to claim 6, wherein the converter internal pressure P2, the top-blown oxygen flow rate F2 and the bottom-blown gas flow rate Q2 in a region in which C is 1–0.1 wt % are controlled so that δ expressed by the following formula (9) is held in the range of 5–25:

$$\delta=\{(F2\times P2)/Q2\}^{1/2}/C \quad (9).$$

11. A pressurized converter steelmaking method according to any one of claims 6 to 10, wherein a ratio L/D of a depth L in m of a cavity formed in the steel bath surface by top-blown oxygen to a bath diameter D in m is controlled to be held in the range of 0.15–0.35.

12. A pressurized converter steelmaking method, wherein the steel bath carbon concentration for starting the control defined in any one of claims 7 to 10 is held in the range of CB×0.6 to CB×1.8, CB being expressed by the formula (10)

$$CB=0.078\times P+0.058\times F-1.3\times Q-0.00069\times Wm+0.49 \quad (10)$$

wherein

P: converter internal pressure in $kg/cm^2$

F: top-blown oxygen flow rate in $Nm^3/ton/min$

Q: bottom-blown gas flow rate in $Nm^3/ton/min$

Wm: amount of molten steel in tons.

13. A pressurized converter steelmaking method according to claim 6, wherein after the steel bath carbon concentration C has entered a region corresponding to the range of CB×0.6 to CB×1.8, CB being expressed by the formula (10), the converter internal pressure P, the top-blown oxygen flow rate F, and the bottom-blown gas flow rate Q are controlled so that CB expressed by the formula (10) is held in the range of C×0.6 to C×1.8

$$CB=0.078\times P+0.058\times F-1.3\times Q-0.00069\times Wm+0.49 \quad (10)$$

wherein

P: converter internal pressure in $kg/cm^2$

F: top-blown oxygen flow rate in $Nm^3/ton/min$

Q: bottom-blown gas flow rate in $Nm^3/ton/min$

Wm: amount of molten steel in tons.

14. A pressurized converter steelmaking method, wherein the steel bath carbon concentration for starting the control defined in claim 11 is held in the range of CB×0.6 to CB×1.8, CB being expressed by the formula (10)

$$CB=0.078\times P+0.058\times F-1.3\times Q-0.00069\times Wm+0.49 \quad (10)$$

wherein

P: converter internal pressure in $kg/cm^2$

F: top-blown oxygen flow rate in $Nm^3/ton/min$

Q: bottom-blown gas flow rate in $Nm^3/ton/min$

Wm: amount of molten steel in tons.

* * * * *